US005359254A

United States Patent [19]

Arkhipov et al.

[11] Patent Number: 5,359,254

[45] Date of Patent: Oct. 25, 1994

[54] PLASMA COMPENSATION CATHODE

[75] Inventors: Boris A. Arkhipov; Yuriy M. Gorbachev; Viktor A. Ivanov; Konstantin N. Kozubsky; Georgy A. Komarov, all of Kaliningrad, Russian Federation

[73] Assignee: Research Institute of Applied Mechanics and Electrodynamics, Moscow, Russian Federation

[21] Appl. No.: 17,577

[22] Filed: Feb. 16, 1993

Related U.S. Application Data

[63] Continuation-in-part of Ser. No. 720,564, Jun. 25, 1991, abandoned.

[30] Foreign Application Priority Data

Jun. 26, 1990 [SU] U.S.S.R. ..... 4843045

[51] Int. Cl.[5] ..... H01J 17/26

[52] U.S. Cl. ..... 313/15; 313/231.31; 313/231.41; 313/362.1; 315/111.21; 315/111.31

[58] Field of Search ..... 313/15, 231.31, 231.41, 313/360.1, 362.1, 363.1; 315/111.21, 111.31

[56] References Cited

U.S. PATENT DOCUMENTS 3,073,987 1/1963 Harper et al. ..... 313/363.1
3,515,932 6/1970 King ..... 313/231.41

OTHER PUBLICATIONS

Schartz, "Heaterless Ignition of Inert Gas Ion Thruster Hollow Cathodes", AJAA Paper, Oct. 1985.

A. K. F. Chan et al, "An electrically efficient, finely tunable, low-power plasma generator," J. Phys D. Appl. Phys. 13 No. 12, 14 Dec. 1980.

Artisimovich et al; "Razaraoka Statsinarnago Plazmennogo dvigatelya i etgo ispytanie na iskusstuennon sputnike zemil Meteor"; Kosmicheski issledovania, 1974, tom XII, uyp3, pp. 455–459.

*Primary Examiner*—Donald J. Yusko
*Assistant Examiner*—N. D. Patel
*Attorney, Agent, or Firm*—Townsend and Townsend Khourie and Crew

[57] ABSTRACT

A plasma compensation cathode includes a casing (1) accommodating coaxially with its outlet hole (2) a hollow holder (3) and a thermal emitter (4) with a central passage (5), a layer (10) of material chemically inert at high temperatures to the materials of the holder and emitter being interposed therebetween. The central passage (5) is blind at the side of admission of gas, and is communicated with the interior of the holder (3) by way of a through passage (8) made in the wall of the thermal emitter (4) so that its axis intersects the axis of passage (5), and longitudinal grooves (9) made in the side surface of the thermal emitter (4) at the location of the inlet holes of the through passage (8). The holder (3) is embraced by heater (6) having a support ring (7) positioned in its midportion and secured in an insulation sleeve (18) separating the heater (6) from the coaxial heat screens (11) interconnected successively to define a sealed cavity (14) wherethrough the interior of the holder (3) communicates with the gas feeding pipe (13) secured in the casing (1) through the support insulator (17). Interposed between mechanical filters (16) and between holder (3) and pipe (13) is a getter (15).

3 Claims, 1 Drawing Sheet

PLASMA COMPENSATION CATHODE

RELATED APPLICATIONS

This is a continuation-in-part application of Ser. No. 07/720,564 filed Jun. 25, 1991 for a Plasma Compensation Cathode, now abandoned.

FIELD OF THE INVENTION

This invention relates generally to glowing compensation cathodes, and more particularly to plasma compensation cathodes.

BACKGROUND OF THE INVENTION

There is known a glowing cathode (cf., Schats M.F. "Heaterless Ignition of Inert Gas. Ion Thruster Hollow Cathodes" AJAA Paper, 1985) comprising a casing, a cylindrical insert secured to the inner surface of the casing and functioning as thermal emitter, a heater secured at the outer side of the casing, and an orifice secured to end face of the casing and acting as the outlet hole of the cathode. This construction of cathode requires high power heaters to heat thermal emitter to a temperature ensuring thermoionic emission sufficient for maintaining a stable discharge.

There is also known a plasma compensation cathode (cf., L.A. Artsimovich, et al. "Razrabotka statsionarnogo plazmennogo dvigatelya i ego ispytanie na iskusstvennom sputnike Zemli Meteor", Kosmicheskie issledovania, 1974, tom XII, vyp. 3, pages 455 and 456, FIG. 5). This compensation cathode has a casing with an outlet hole at one wall thereof, the casing accommodating coaxially to its outlet hole a tubular holder receiving a thermal emitter with a central through passage. The compensation cathode also includes a heater embracing the tubular holder, and heat screens positioned between the holder and casing walls. Connected to the tubular holder is a pipe for feeding gas to the interior of the casing and to the passage of thermal emitter through its inlet portion. This pipe is secured in the casing through an insulator.

During operation of the compensation cathode, gas is conveyed through the tubular holder to the passage of the thermal emitter. Heated to a high temperature, the thermal emitter ensures emission of electrons sufficient for maintaining stable electric discharge between the inner surface of the thermal emitter and anode of the plasma source. After bringing the device to steady-state operation conditions the heater is deenergized, and the compensation cathode continues to operate automatically, whereby the preferred temperature level is ensured by the energy liberated in the catholyte layer approximating to the product of ionic current resulting from discharge by the potential drop at the cathode. However, in the course of operation the discharge can move from the passage of thermal emitter to the interior of tubular holder resulting in evaporation of the material of the holder and fouling of the passage with holder material to almost complete clogging. As a result, thermoemission surfaces tend to degrade, and thermoemission current tends to decrease thereby reducing the service life of the compensation cathode to only tens of hours. In addition, direct connection of the holder of thermal emitter to the gas feeding pipe leads to vigorous heat transfer from the emitter to outer structural parts, and consequently to move prominent catholyte potential drop ensuring the energy necessary for maintaining automatic operating conditions. More prominent catholyte potential drop also leads to reduced service life of the thermal emitter because of intensified ionic bombardment. In addition, tight contact of thermoemissive materials with the holder at high working temperatures is accompanied by active chemical interaction, such as penetration of boron followed by formation of metal borides, which in turn causes embrittlement and cracking of the holder material and thermal emitter to result in irreversible deformation of the holder. This disadvantageous effect is especially pronounced at starting operating conditions accompanied by the highest temperature levels, which limits the service life and reduces the total number of engagements of the compensation cathode. Also, the helical heater embracing the tubular holder is characterized by low rigidity to result in sagging and deformation of its coils resulting in possible contact of the coils with the holder or thermal screens and short-circuiting of the heater. This in turn leads to fewer engagements of the compensation cathode and reduced service life thereof. In addition, the working gas can contain negligible quantities of such admixtures as oxygen, water, or the like, tending to react at high working temperatures with the material of the thermal emitter and affecting the thermoemissive characteristics of the material. Extended operation for tens or hundreds of hours makes this disadvantageous effect even more prominent to reduce the service life of the compensation cathode.

SUMMARY OF THE INVENTION

The present invention aims at providing a plasma compensation cathode which would be so constructed as to lock discharge zone in the passage of the thermal emitter, prevent chemical interaction of the thermal emitter with the material of the holder and with the thermal system maintaining automatically the preferred temperature of the thermal emitter at minimized cathodic potential drop, and also to increase the rigidity of the heater and facilitate additional cleaning of gas from impurities.

The aim of the invention is attained by that in a plasma compensation cathode comprising a casing accommodating coaxially with its outlet hole a hollow holder and thermal emitter having a central passage communicating with the interior of the holder, a heater embracing the holder, heat screens positioned between the heater and walls of the casing, and a pipe for feeding gas to the interior of the holder secured in a support insulator, according to the invention, the central passage of the thermal emitter is blind at the side of admission of gas and is communicated with the interior of the holder by way of a through passage made in the wall of the thermal emitter so that its axis intersects the axis of the central passage, and longitudinal grooves provided at the side surface of the thermal emitter at the location of inlet holes of the through passage, whereas the interior of the holder communicates with the gas feeding pipe through a sealed cavity defined by clearances between the coaxial heat screens successively interconnected by spacer rings and secured at the gas feeding pipe, underlying the holder in this cavity is a getter positioned between mechanical filters, the space between the inner surface of the holder and side surface of the thermal emitter accommodating a layer of material chemically inert at high working temperatures to the materials of the holder and thermal emitter, whereas the heater has a support ring located at its midportion and secured in an insulation sleeve separating the heater from the heat screens.

The use in the proposed plasma compensation cathode of a thermal emitter with a special passage for feeding gas, a layer of chemically inert material, a system of coaxial heat screens, a support ring, an insulation sleeve, a getter, and mechanical filters makes it possible to substantially extend the service life and increase the total number of actuations of the cathode.

BRIEF DESCRIPTION OF THE DRAWINGS

The invention will now be described in greater detail with reference to a specific embodiment thereof taken in conjunction with the accompanying drawings in which.

DESCRIPTION OF THE PREFERRED EMBODIMENTS

Figure 1:
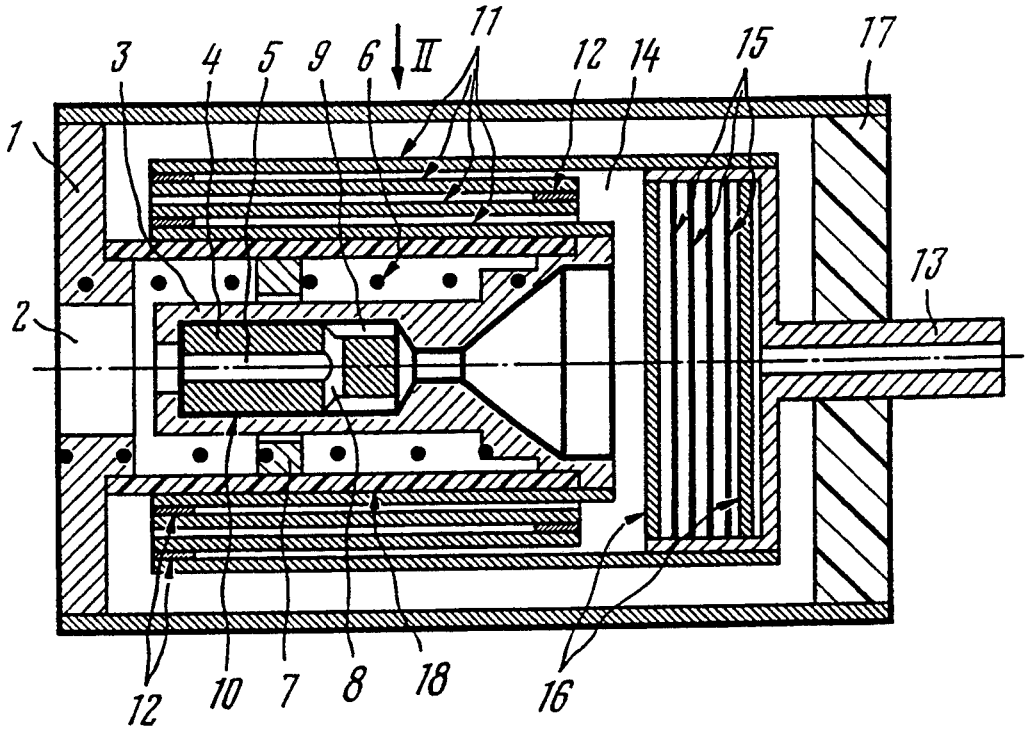
FIG. 1 shows a general view of the proposed plasma compensation cathode.

A plasma compensation cathode comprises a casing 1 (FIG. 1) having an outlet hole 2. The casing accommodates coaxially a hollow holder 3 and a thermal emitter 4 with a central passage 5. The holder 3 is positioned inside casing 1 coaxially with the outlet hole 2 and embraced by a heater 6 fashioned as a spiral, one end of which is secured to the casing and the other to the holder 3. The heater 6 is provided with a support ring 7 located at its midportion and functioning as an additional support point.

Figure 2:
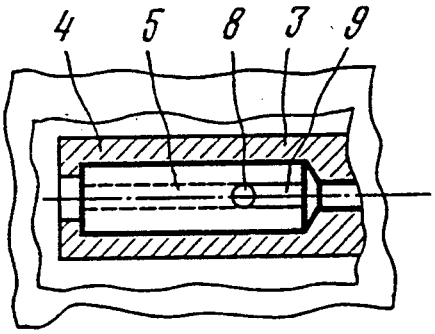
FIG. 2 is a section taken along line I—I in FIG. 1.

The central passage 5 of thermal emitter 4 has a closed end towards the side of the casing having inlet pipe 13 and communicates with the interior of the holder 3 by way of a central passage 8 (FIG. 2) made in the wall of the thermal emitter 4, the axis of this passage extending perpendicularly to the axis of the central passage 5, and longitudinal grooves 9 provided at the side surface of the thermal emitter 4 at the location of the inlet holes of the through passage 8.

Occupying the space between the inner surface of the holder 3 and side surface of the thermal emitter 4 is a layer 10 (FIG. 1) of material chemically inert at high temperatures to the materials of the holder 3 and thermal emitter 4. Typically, $LaB_6$ is used for the thermal emitter 4 and molybdenum for the holder 3. The inert layer between the emitter and the holder is then typically pyrographite. Pyrographite can also be used for the inert layer when holder 3 is made of niobium or tantalum and the thermal emitter 4 is made of other activated materials such as, for example, wolfram-barium compositions. Instead of pyrographite for the inert layer, zirconium nitrides or hafnium can be used. When zirconium nitrides or hafnium is used for the inert layer, molybdenum can be used for holder 3 and $LaB_6$ for the thermal emitter. Those skilled in the art are familiar with other materials for the layer 10 which are chemically inert at high temperatures to the materials of the holder and to the thermal emitter.

Positioned between the heater 6 and walls of casing 1 is a system of coaxial heat screens 11 connected successively through spacer rings 12 and secured at pipe 13 for feeding gas to define a sealed cavity 14 wherethrough the interior of the holder 3 communicates with the gas feeding pipe 13. A space between the holder 3 and pipe 13 accommodates a getter 15 positioned between mechanical filters 16, whereas the pipe 13 is secured in a support insulator 17. The heater 6 is separated from the system of heat screens 11 by an insulation sleeve 18 in which the support ring 7 is secured.

In operation of the proposed plasma compensation cathode the gas flows along the pipe 13 through the getter 15 and mechanical filters 16 to the interior of the holder 3, and then through the grooves 9 and 8 to the central passage 5 of the thermal emitter 4. The heater 6 acts to heat the thermal emitter 4 to a temperature ensuring emission of electrons sufficient for sustaining a stable electric discharge between the inner surface of the thermal emitter 4 and anode (not shown) of a plasma source. After bringing the device to steady state operating conditions the heater 6 is deenergized and compensation cathode operates automatically, whereby the required temperature level of the thermal emitter 4 is ensured thanks to the energy resulting from the discharge.

When the central passage 5 at the side of admission of gas is blind, the electric discharge in passage 5 can be stabilized by changing the pressure of gas in the passage 5. This prevents fixation of discharge at the walls of holder 3 resulting in fouling and clogging of passage 5 of the thermal emitter 4, which facilitates maintaining the initial thermal emission from the inner surface of the thermal emitter 4 and substantially increases the service life of the compensation cathode. Positioning between the inner surface of holder 3 and side surface of the thermal emitter 4 of layer 10 of material chemically inert to the material of holder 3 and thermal emitter 4 obviates chemical interaction and diffusion of materials thereby making impossible irreversible deformation of holder 3 and cracking of holder 3 and thermal emitter 4. The accompanying advantage is substantially increased number of actuations and extended service life of the cathode.

The system of coaxial heat screens 11 defining with gas feeding pipe 13 and holder 3 sealed cavity 14 makes it possible to substantially reduce the heat flow from holder 3 of the thermal emitter 4 to outer parts of the cathode structure and, as a consequence, to reduce the potential drop at the cathode to the level of gas ionization potential and substantially extend the service life of the compensation cathode.

Provision of the support ring 7 secured in the insulation sleeve 18 allows to increase rigidity of the spiral of heater 6, prevent short-circuiting of the spiral of heater 6 (viz., engagement of the spiral coils with holder 3 or screens 11) even at a substantial deformation of spiral coils due to multiple engagement thermocycles. This again enables to increase the number of actuations and extend the service life of the compensation cathode.

Provision of the proposed compensation cathode with getter 15 positioned between mechanical filters 16 immediately at the location where the gas is admitted to the interior of the holder 3 affords extra fine chemical cleaning of gas from admixtures of oxygen, water, and the like, and ensures more stable thermoemission characteristics of thermal emitter 4 resulting in an extended service life of the compensation cathode.

The invention can be used for neutralizing ion beams in accelerators with closed electron drift and extended acceleration zone, in accelerators with anodic layer and narrow acceleration zone, in plasma-ion accelerators, and also for compensating space and surface discharges.

What is claimed is:

1. A plasma compensation cathode comprising:

an outer casing defining an enclosed chamber and an outlet hole having a longitudinal axis and located at a side of said casing;

inlet pipe means for feeding a gas into said chamber and a support insulator securing the pipe to said casing on a side of the casing opposite said outlet hole;

a plurality of filters located in the chamber adjacent said inlet pipe and disposed transversely to said longitudinal axis, and a getter between said filters;

a plurality of tubular heat screens in said chamber coaxially connected with said inlet pipe and separated by sealing, annular spacers, said heat screens being interposed between said outlet hole and said inlet pipe and further defining a cavity formed by an innermost one-of said screens and at least one of said filters; and a tubular holder in said cavity and coaxial to said outlet hole, a thermal emitter disposed inside said holder, a heater disposed about the holder and located between the holder and the heat screens, and an insulation sleeve between said heat screens and said heater, said thermal emitter having an outer surface proximate an interior surface of the holder and a layer of material disposed therebetween which is chemically inert at high temperatures to the material of the holder and the emitter, said emitter including a central passage therethrough coaxial to said outlet hole, said central passage terminating short of an axial end of the emitter proximate the inlet pipe, said emitter further including at least one axially oriented groove on its outer surface extending from the end of the emitter proximate the inlet pipe towards and short of an opposite end of the emitter, and at least one radially extending inlet aperture extending from said passage to said at least one groove, whereby gas can pass from said hollow cavity along said at least one groove and into said central passage through said inlet aperture.

2. A plasma compensation cathode according to claim 1 wherein the layer comprises pyrographite.

3. A plasma compensation cathode according to claim 1 wherein the layer comprises a material selected from the group consisting of zirconium nitrides and hafnium.

* * * * *